US007386446B2

(12) United States Patent
Schuller et al.

(10) Patent No.: US 7,386,446 B2
(45) Date of Patent: Jun. 10, 2008

(54) PREDICTIVE CODING SCHEME WITH ADAPTIVE SPEED PARAMETERS

(75) Inventors: Gerald Schuller, Erfurt (DE); Manfred Lutzky, Nuremberg (DE); Ulrich Kraemer, Ilmenau (DE); Stefan Wabnik, Ilmenau (DE); Jens Hirschfeld, Heringen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 11/462,140

(22) Filed: Aug. 3, 2006

(65) Prior Publication Data

US 2007/0016409 A1 Jan. 18, 2007

Related U.S. Application Data

(63) Continuation of application No. PCT/EP2004/014496, filed on Dec. 20, 2004.

(30) Foreign Application Priority Data

Feb. 13, 2004 (DE) ..... 10 2004 007 185

(51) Int. Cl.
*G10L 19/04* (2006.01)
*H03M 7/38* (2006.01)

(52) U.S. Cl. ..... 704/219; 341/51; 370/465; 375/240.02

(58) Field of Classification Search ..... 704/219; 341/51; 370/465; 375/240.02
See application file for complete search history.

(56) References Cited

U.S. PATENT DOCUMENTS 3,631,520 A * 12/1971 Atal ..... 704/219
3,931,596 A * 1/1976 Gersho et al. ..... 341/143
4,475,227 A 10/1984 Belfield (Continued)

FOREIGN PATENT DOCUMENTS

DE 37 14589 A1 11/1988

OTHER PUBLICATIONS

Bilcu et al., "LMS Adaptive Filter with Optimum Step-Size for Tracking Time-Varying Channels", 3rd International Symposium on Image and Signal Processing and Analysis, 2003. ISPA 2003, Sep. 18-20, 2003, vol. 2, pp. 883 to 887.*

(Continued)

*Primary Examiner*—Martin Lerner
(74) *Attorney, Agent, or Firm*—Daniel J. Santos

(57) ABSTRACT

If an adaptive prediction algorithm controllable by a speed coefficient is started from to operate with a first adaption speed and a first adaption precision and an accompanying first prediction precision in the case that the speed coefficient has a first value and to operate with a second, compared to the first one, lower adaption speed and a second, but compared to the first one, higher precision in the case that the speed parameter has a second value, the adaption durations occurring after the reset times where the prediction errors are at first increased due to the, not yet, adapted prediction coefficients may be decreased by at first setting the speed parameter to the first value and, after a while, to a second value. After the speed parameter has again been set to the second value after a predetermined duration after the reset times, the prediction errors and thus the residuals to be transmitted are more optimized or smaller than would be possible with the first speed parameter value.

26 Claims, 5 Drawing Sheets

U.S. PATENT DOCUMENTS

| | | | | |
|---|---|---|---|---|
| 4,518,950 | A * | 5/1985 | Petr | 341/51 |
| 4,677,423 | A * | 6/1987 | Benvenuto et al. | 341/51 |
| 4,751,736 | A * | 6/1988 | Gupta et al. | 704/230 |
| 4,827,340 | A | 5/1989 | Pirsch | |
| 5,535,299 | A | 7/1996 | Riedel | |
| 5,631,644 | A * | 5/1997 | Katata et al. | 341/67 |
| 6,078,620 | A * | 6/2000 | Rennig | 375/244 |
| 6,104,996 | A | 8/2000 | Yin | |
| 6,360,200 | B1 | 3/2002 | Edler et al. | |
| 6,784,812 | B2 * | 8/2004 | Craven et al. | 341/50 |
| 7,050,967 | B2 * | 5/2006 | Gigi | 704/206 |
| 7,272,554 | B2 * | 9/2007 | Serizawa et al. | 704/219 |
| 2003/0191634 | A1 | 10/2003 | Thomas | |

OTHER PUBLICATIONS

Mathews et al., "A Stochastic Gradient Adaptive Filter with Gradient Adaptive Step Size", IEEE Transactions on Signal Processing, Jun. 1993, vol. 41, Issue 6, pp. 2075 to 2087.*

Schulter et al., "Lossless Coding of Audio Signals Using Cascaded Prediction", Proceedings IEEE International Conference on Acoustics, Speech, and Signal Processing, 2001, May 7-11, 2001, vol. 5, pp. 3273 to 3276.*

Wabnik et al., "Different Quantisation Noise Shaping Methods for Predictive Audio Coding", IEEE International Conference on Acoustics, Speech, and Signal Processing, 2006. ICASSP 2006, vol. 5, pp. V-185 to V-188.*

C.E. Davila, "A Recursive Least-Squares Algorithm with Data-Adaptive Step Size", Conference on Acoustics, Speech, and Signal Processing, 1989. ICASSP-89. May 23-26, 1989, vol. 2, pp. 912 to 915.*

Irvine-Halliday, Dave et al., "New Technique for Reducing the Angle Random Walk at the Output of Fiber Optic Gyroscopes During Alignment Processes of Inertial Navigation Systems," Society of Photo-Optical Instrumentation Engineers, Oct. 2001, pp. 2097-2106, vol. 40, No. 10.

Huffman, Stephen D. et al., "Adaptive Linear Estimation Based on Time Domain Orthogonality," CH1559—4/80/0000-0453S00.75 copyright 1980 IEEE.

* cited by examiner

PREDICTIVE CODING SCHEME WITH ADAPTIVE SPEED PARAMETERS

CROSS-REFERENCE TO RELATED APPLICATION

This application is a continuation of copending International Application No. PCT/EP2004/014496, filed Dec. 20, 2004, which designated the United States and was not published in English, and is incorporated herein by reference in its entirety, and which claimed priority to German Patent Application No. 10 2004 007 185.3, filed Feb. 13, 2004.

BACKGROUND OF THE INVENTION

1. Field of the Invention

The present invention relates to the predictive coding of information signals, such as, for example, audio signals, and in particular to adaptive predictive coding.

2. Description of the Related Art predictive coder—or transmitter—codes signals by predicting a current value of the signal to be coded by the previous or preceding values of the signal. In the case of linear prediction, this prediction or presumption is accomplished via the current value of the signal by a weighted sum of the previous values of the signal. The prediction weights or prediction coefficients are continuously adjusted or adapted to the signal so that the difference between the predicted signal and the actual signal is minimized in a predetermined manner. The prediction coefficients, for example, are optimized with regard to the square of the prediction error. The error criterion when optimizing the predictive coder or predictor, however, may also be selected to be something else. Instead of using the least square error criterion, the spectral flatness of the error signal, i.e. of the differences or residuals, may be minimized.

Only the differences between the predicted values and the actual values of the signal are transmitted to the decoder or receiver. These values are referred to as residuals or prediction errors. The actual signal value can be reconstructed in the receiver by using the same predictor and by adding the predicted value obtained in the same manner as in the coder to the prediction error having been transmitted by the coder.

The prediction weights for the prediction may be adapted to the signal with a predetermined speed. In the so-called least mean squares (LMS) algorithm, one parameter is used for this. The parameter must be adjusted in a manner acting as a trade-off between adaption speed and precision of the prediction coefficients. This parameter, which is sometimes also referred to as step-size parameter, thus determines how fast the prediction coefficients adapt to an optimum set of prediction coefficients, wherein a set of prediction coefficients not adjusted optimally results in the prediction to be less precise and thus the prediction errors to be greater, which in turn results in an increased bit rate for transmitting the signal since small values or small prediction errors or differences can be transmitted by fewer bits than greater ones.

A problem in predictive coding is that in the case of transmitting errors, i.e. if incorrectly transmitted prediction differences or errors occur, prediction will no longer be the same on the transmitter and receiver sides. Incorrect values will be reconstructed since, when a prediction error first occurs, it is added on the receiver side to the currently predicted value to obtain the decoded value of the signal.

Subsequent values, too, are affected since the prediction on the receiver side is performed based on the signal values already decoded.

In order to obtain resynchronization or adjustment between transmitter and receiver, the predictors, i.e. the prediction algorithms, are reset to a certain state on the transmitter and receiver sides at predetermined times equal for both sides, a process also referred to as reset.

However, it is problematic that directly after such a reset the prediction coefficients are not adjusted to the signal at all. The adaption of these prediction coefficients, however, will always require some time starting from the reset times. This increases the mean prediction error resulting in an increased bit rate or reduced signal quality, such as, for example, due to distortions.

SUMMARY OF THE INVENTION

Consequently, it is an object of the present invention to provide a scheme for predictive coding of an information signal which, on the one hand, allows more sufficient robustness to errors in the difference value or residuals of the coded information signal and, on the other hand, allows a lower accompanying increase in the bit rate or decrease in signal quality.

In accordance with a first aspect, the present invention provides a method for predictively coding an information signal including a sequence of information values by means of an adaptive prediction algorithm the prediction coefficients of which may be initialized and which is controllable by a speed parameter to operate with a first adaption speed and a first adaption precision in the case that the speed parameter has a first value and to operate with a second, compared to the first one, lower adaption speed and a second, compared to the first one, higher adaption precision in the case that the speed parameter has a second value, having the steps of: A) initializing the prediction coefficients; B) controlling the adaptive prediction algorithm to set the speed parameter to the first value; C) coding successive information values of the information signal by means of the adaptive prediction algorithm with the speed parameter set to the first value as long as a predetermined duration after step B) has not expired to code a first part of the information signal; D) after expiry of the predetermined duration after step B), controlling the adaptive prediction algorithm to set the speed parameter to the second value; and E) coding information values of the information signal following the information values coded in step C) by means of the adaptive prediction algorithm with the speed parameter set to the second value to code a second part of the information signal following the first part.

In accordance with a second aspect, the present invention provides a device for predictively coding an information signal including a sequence of information values, having: means for performing an adaptive prediction algorithm the prediction coefficients of which may be initialized and which is controllable by a speed parameter to operate with a first adaption speed and a first adaption precision in the case that the speed parameter has a first value and to operate with a second, compared to the first one, lower adaption speed and a second, compared to the first one, higher adaption precision in the case that the speed parameter has a second value; and control means coupled to the means for performing the adaptive prediction algorithm and effective to cause: A) initialization of the prediction coefficients; B) control of the adaptive prediction algorithm to set the speed parameter to the first value; C) coding of successive information values of the information signal by means of the adaptive prediction algorithm with the speed parameter set to the first value as long as a predetermined duration after the control B) has not expired to code a first part of the information signal; D) after expiry of the predetermined duration after the control B), control of the adaptive prediction algorithm to set the speed parameter to the second value; and E) coding of information values of the information signal following the information values coded in the coding C) by means of the adaptive prediction algorithm with the speed parameter set to the second value to code a second part of the information signal following the first part.

In accordance with a third aspect, the present invention provides a method for decoding a predictively coded information signal including a sequence of difference values by means of an adaptive prediction algorithm the prediction coefficients of which may be initialized and which is controllable by a speed parameter to operate with a first adaption speed and a first adaption precision in the case that the speed parameter has a first value and to operate with a second, compared to the first one, lower adaption speed and a second, compared to the first one, higher adaption precision in the case that the speed parameter has a second value, having the steps of: F) initializing the prediction coefficients; G) controlling the adaptive prediction algorithm to set the speed parameter to the first value; H) decoding successive difference values of the predictively coded information signal by means of the adaptive prediction algorithm with the speed parameter set to the first value as long as a predetermined duration after step G) has not expired to decode a first part of the predictively coded information signal; I) after expiry of the predetermined duration after step G), controlling the adaptive prediction algorithm to set the speed parameter to the second value; and J) decoding difference values of the predictively coded information signal following the difference values decoded in step H) by means of the adaptive prediction algorithm with the speed parameter set to the second value to decode a second part of the predictively coded information signal.

In accordance with a fourth aspect, the present invention provides a device for decoding a predictively coded information signal including a sequence of difference values, having: means for performing an adaptive prediction algorithm the prediction coefficients of which may be initialized and which is controllable by a speed parameter to operate with a first adaption speed and a first adaption precision in the case that the speed parameter has a first value and to operate with a second, compared to the first one, lower adaption speed and a second, compared to the first one, higher adaption precision in the case that the speed parameter has a second value; and control means coupled to the means for performing the adaptive prediction algorithm and effective to cause: F) initialization of the prediction coefficients; G) control of the adaptive prediction algorithm to set the speed parameter to the first value; H) decoding of successive difference values of the predictively coded information signal by means of the adaptive prediction algorithm with the speed parameter set to the first value as long as a predetermined duration after the control G) has not expired to decode a first part of the predictively coded information signal; I) after expiry of the predetermined duration after the control G), control of the adaptive prediction algorithm to set the speed parameter to the second value; and J) decoding of difference values of the predictively coded information signal following the difference values decoded in the decoding H) by means of the adaptive prediction algorithm with the speed parameter set to the second value to decode a second part of the predictively coded information signal.

In accordance with a fifth aspect, the present invention provides a computer program having a program code for performing one of the above mentioned methods when the computer program runs on a computer.

The present invention is based on the finding that the, up to now, fixed setting of the speed parameter of the adaptive prediction algorithm acting as the basis of predictive coding has to be given up in favor of a variable setting of this parameter. If an adaptive prediction algorithm controllable by a speed coefficient is started from to operate with a first adaption speed and a first adaption precision and an accompanying first prediction precision in the case that the speed coefficient has a first value and to operate with a second, but compared to the first one, lower adaption speed and a second, compared to the first one, higher precision in the case that the speed parameter has a second value, the adaption durations occurring after the reset times where the prediction errors are at first increased due to the prediction coefficients having not yet been adapted can be decreased by at first setting the speed parameter to the first value and, after a while, to the second value. After setting the speed parameter again to the second value after a predetermined duration after the reset times, the prediction errors and thus the residuals to be transmitted are more optimized or smaller than would be possible with the first speed parameter value.

Put differently, the present invention is based on the finding that prediction errors can be minimized after reset times by altering the speed parameters, such as, for example, the step-size parameter of an LMS algorithm, for a certain duration after the reset times such that the speed of the adaption of the weights is increased for this duration—of course entailing reduced precision.

BRIEF DESCRIPTION OF THE DRAWINGS

Preferred embodiments of the present invention will be detailed subsequently referring to the appended drawings, in which.

DESCRIPTION OF PREFERRED EMBODIMENTS

Figure 1:
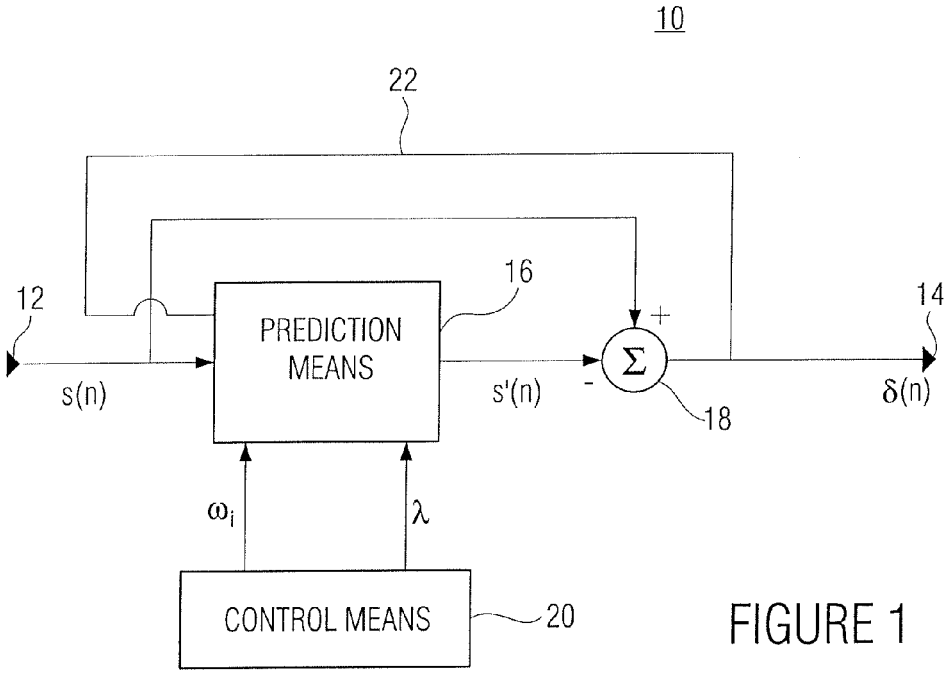
FIG. 1 shows a block circuit diagram of a predictive coder according to an embodiment of the present invention.

Before discussing embodiments of the present invention in greater detail referring to the figures, it is pointed out that elements occurring in different figures are provided with same reference numerals and that a repeated description of these elements is omitted.

FIG. 1 shows a predictive coder 10 according to an embodiment of the present invention. The coder 10 includes an input 12 where it receives the information signal s to be coded and an output 14 where it outputs the coded information signal δ.

The information signal may be any signal, such as, for example, an audio signal, a video signal, a measuring signal or the like. The information signal s consists of a sequence of information values s(i), i∈ℕ, i.e. audio values, pixel values, measuring values or the like. The coded information signal δ includes, as will be discussed in greater detail below, a sequence of difference values or residuals δ(i), i∈ℕ, corresponding to the signal values s(i) in the manner described below.

Internally, the coder 10 includes prediction means 16, a subtracter 18 and control means 20. The prediction means 16 is connected to the input 12 in order to calculate, as will be discussed in greater detail below, a predicted value s'(n) from previous signal values s(m), m<n and m∈ℕ, for a current signal value s(n) and to output same to an output which in turn is connected to an inverting input of the subtracter 18. A non-inverting input of the subtracter 18 is also connected to the input 12 to subtract the predicted value s'(m) from the actual signal value s(n)— or simply to calculate the difference of the two values— and to output the result at the output 14 as the difference value δ(n).

The prediction means 16 implements an adaptive prediction algorithm. In order to be able to perform the adaption, it receives the difference value δ(n)—also referred to as prediction error—at another input via a feedback path 22. In addition, the prediction means 16 includes two control inputs connected to the control means 20. By means of these control inputs, the control means 20 is able to initialize prediction coefficients or filter coefficients $\omega_i$ of the prediction means 16 at certain times, as will be discussed in greater detail below, and to change a speed parameter of the prediction algorithm on which the prediction means 16 is based, which subsequently will be referred to by λ.

After the setup of the coder 10 of FIG. 1 has been described above referred to FIG. 1, the mode of functioning thereof will be described subsequently referring to FIG. 2, also referring to FIG. 1, wherein subsequently it is assumed that it is just about to process an information signal s to be coded, i.e. signal values s(m), m<n, have already been coded.

In step 40, the control means 20 at first initializes the prediction or filter coefficients $\omega_i$ of the prediction means 16. The initialization according to step 40 takes place at predetermined reset times. The reset times or, more precisely, the signal value numbers n where a reset according to step 40 has been performed may, for example, occur in fixed time intervals. The reset times may be reconstructed on the decoder side, for example by integrating information about same in the coded information signal δ or by standardizing the fixed time interval or the fixed number of signal values between same.

The coefficients $\omega_i$ are set to any values which may, for example, be the same at any reset time, i.e. every time step 40 is executed. Preferably, the prediction coefficients are initialized in step 40 to values having been derived heuristically from typical representative information signals and having resulted, on average, i.e. over the representative set of information signals, such as, for example, a mixture of jazz, classical, rock etc. pieces of music, in an optimum set of prediction coefficients.

In step 42, the control means 20 sets the speed parameter λ to a first value, wherein steps 40 and 42 are preferably executed essentially simultaneously to the reset times. As will become obvious subsequently, the setting of the speed parameter to the first value has the result that the prediction means 16 performs a quick adaption of the prediction coefficients $\omega_i$ initialized in step 40—of course entailing reduced adaption precision.

In step 44, the prediction means 16 and the subtracter 18 cooperate as prediction means to code the information signal s and, in particular, the current signal value s(n) by predicting same using adaption of the prediction coefficients $\omega_i$. More precisely, step 44 includes several substeps, namely calculating a predicted value s'(n) for the current signal value s(n) by the prediction means 16 using previous signal values s(m), m<n, using the current prediction coefficients $\omega_i$, subtracting the value s'(n) predicted in this way from the actual signal value s(n) by the subtracter 18, outputting the resulting difference value δ(n) at the output 14 as part of the coded information signal δ and adapting or adjusting the coefficients $\omega_i$ by the prediction means 16 using the prediction error or difference value δ(n) it obtains via the feedback path 22.

The prediction means 16 uses, for the adaption or adjustment of the prediction coefficients $\omega_i$, the speed parameter λ predetermined or set by the control means 20 which, as will be discussed in greater detail below referring to the embodiment of an LMS algorithm, determines how strongly the feedback prediction error δ(n) per adjustment iteration, here n, influences the adaption or update of the prediction coefficients $\omega_i$ or how strongly the prediction coefficients $\omega_i$ can change depending on the prediction error δ(n) per adaption iteration, i.e. per δ(n) fed back.

In step 46, the control means 20 checks whether the speed parameter λ is to be altered or not. The determination of step 46 can be performed in different manners. Exemplarily, the control means 20 determines that a speed parameter change is to be performed when a predetermined duration has passed since the initialization or setting in step 40 and 42, respectively. Alternatively, the control means 20 for determining evaluates, in step 46, an adaption degree of the prediction means 16, such as, for example, the approximation to an optimum set of coefficients $\omega_i$ with correspondingly low means prediction errors, as will be discussed in greater detail below.

It is assumed that at first no speed parameter change is recognized in step 46. In this case, the control means 20 checks in step 48 whether there is again a reset time, i.e. a time when for reasons of resynchronization the prediction coefficients are to be initialized again. At first, it is again assumed that there is no reset time. If there is no reset time, the prediction means 16 will continue coding the next signal value, as is indicated in FIG. 2 by "n→n+1". In this manner, coding of the information signal s using adaption of the prediction coefficients $\omega_i$ with the adaption speed, as is set by the speed parameter λ is continued until finally the control means 20 determines in step 46 when passing the loop 44, 46, 48 that a speed parameter change is to be performed. In this case, the control means 20 sets the speed parameter λ to a second value in step 50. Setting the speed parameter λ to the second value results in the prediction means 16, when passing the loop 44-48, to perform, in step 44, the adaption of the prediction coefficients $\omega_i$ with a lower adaption speed from then on, however, with increased adaption precision so that in these passes following the speed parameter change time which refer to subsequent signal values of the information signal s, the resulting residuals δ(n) will become smaller, which in turn allows an increased compression rate when integrating the values δ(n) in the coded signal.

After having passed the loop 44-48 several times, the control means 20 will at some time recognize a reset time in step 48, whereupon the functional flow starts over again at step 40.

It is also to be pointed out that the manner in which the sequence of difference values δ(n) is integrated in the coded information signal δ has not been described in detail above. Although it would be possible to integrate the difference values δ(n) in the coded signal in a binary representation having a fixed bit length, it is, however, of more advantage to code the difference values δ(n) with a variable bit length, such as, for example, Huffman coding or arithmetic coding or another entropy coding. A bit rate advantage or an advantage of a smaller amount of bits required for coding the information signal s results in the coder 10 of FIG. 1 by the fact that after the reset times the speed parameter λ is temporarily at first set such that the adaption speed is great so that the prediction coefficients not having been adapted so far are adapted quickly, and then the speed parameter is set such that the adaption precision is greater so that subsequent prediction errors are smaller.

Figure 3:
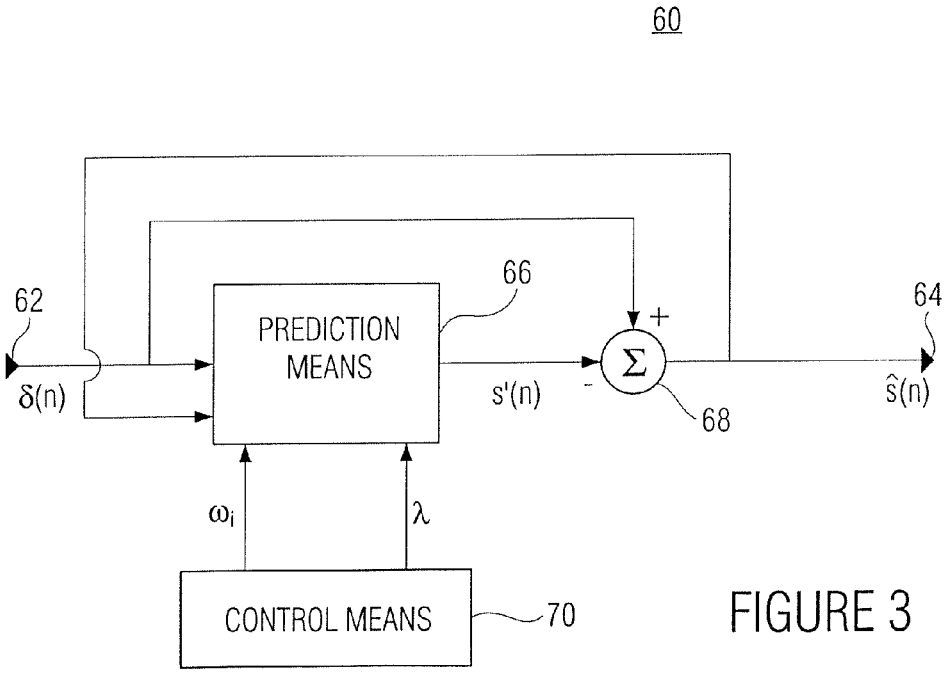
FIG. 3 shows a block circuit diagram of a decoder corresponding to the coder of FIG. 1 according to an embodiment of the present invention.
Figure 4:
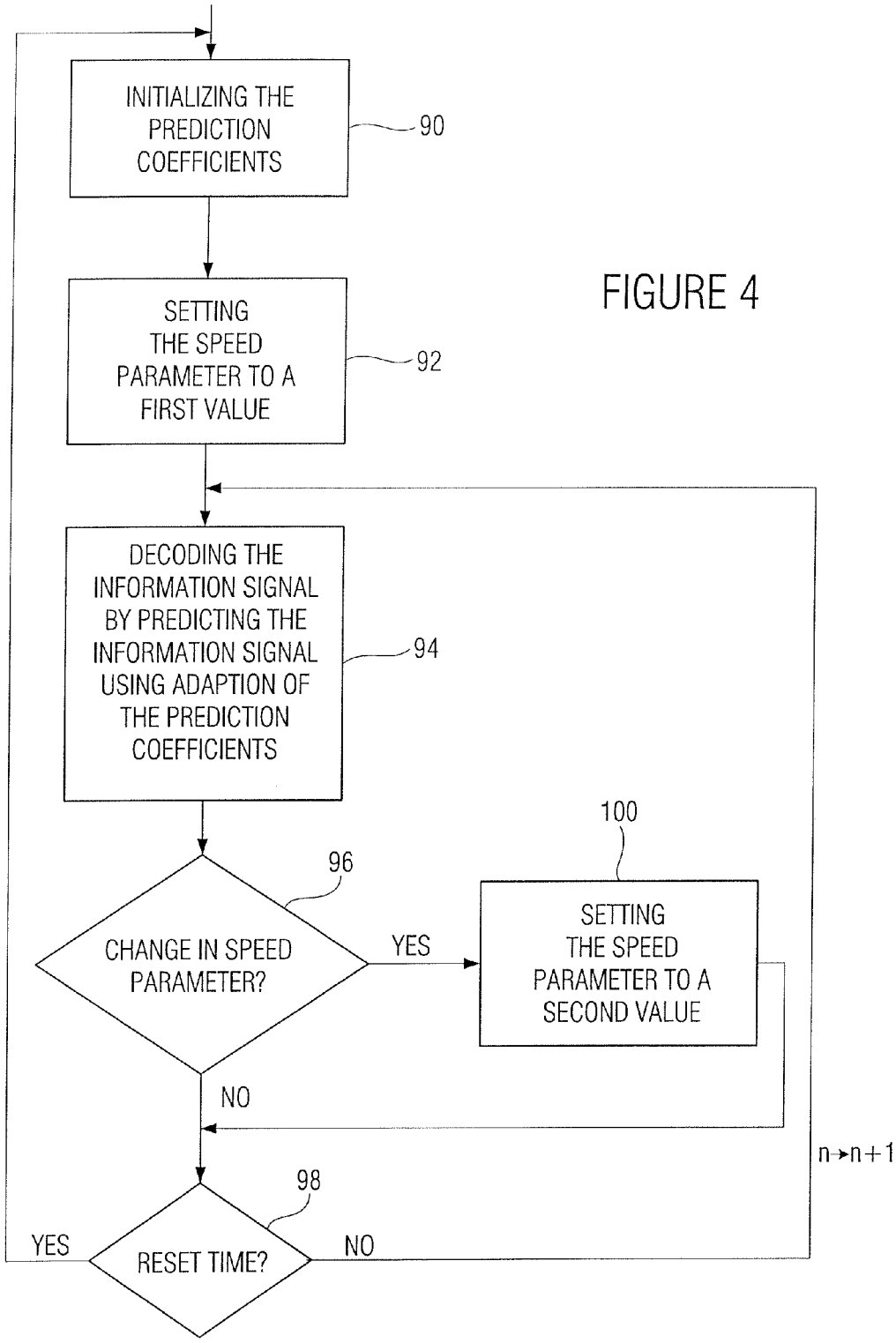
FIG. 4 shows a flowchart for illustrating the mode of functioning of the decoder of FIG. 3.

Now that the predictive coding according to an embodiment of the present invention has been described above, a decoder corresponding to the coder of FIG. 1 will be described subsequently in its setup and mode of functioning referring to FIGS. 3 and 4 according to an embodiment of the present invention. The decoder is indicated in FIG. 3 by the reference numeral 60. It includes an input 62 for receiving the coded information signal δ consisting of the difference values or residuals δ(n), an output 64 for outputting the decoded information signal ŝ which corresponds to the original information signal s(n) except for rounding errors in the representation of the difference value δ(n) and correspondingly consists of a sequence of decoded signal values ŝ(n), prediction means 66 being identical to or having the same function as the one of the coder 10 of FIG. 1, an adder 68 and control means 70. It is pointed out that subsequently no differentiation is made between the decoded signal values ŝ(n) and the original signal values s(n), but both will be referred to as s(n), wherein the respective meaning of s(n) will become clear from the context.

An input of the prediction means 66 is connected to the output 64 to obtain signal values s(n) already decoded. From these signal values s(m), m<n, already decoded the prediction means 66 calculates a predicted value s'(n) for a current signal value s(n) to be decoded and outputs this predicted value to a first input of the adder 68. A second input of the adder 68 is connected to the input 62 to add the predicted value s'(n) and the difference value δ(n) and to output the result or the sum to the output 64 as a part of the decoded signal ŝ and to the input of the prediction means 66 for predicting the next signal value.

Another input of the prediction means 66 is connected to the input 62 to obtain the difference value δ(n), wherein it then uses this value to adapt the current prediction coefficients $\omega_i$. Like in the prediction means 16 of FIG. 1, the prediction coefficients $\omega_i$ may be initialized by the control means 70, like the speed parameter λ may be varied by the control means 70.

The mode of functioning of the decoder 60 will be described subsequently referring at the same time to FIGS. 3 and 4. In steps 90 and 92 corresponding to steps 40 and 42, the control means 70 at first initializes the prediction coefficients $\omega_i$ of the prediction means 66 and sets the speed parameter λ thereof to a first value corresponding to a higher adaption speed, but a reduced adaption precision.

In step 94, the prediction means 66 decodes the coded information signal δ or the current difference value δ(n) by predicting the information signal using adaption of the prediction coefficients $\omega_i$. More precisely, step 94 includes several substeps. At first, the prediction means 66 knowing the signal values s(m) already decoded, m<n, predicts the current signal value to be determined therefrom to obtain the predicted value s'(n). Thus, the prediction means 66 uses the current prediction coefficients $\omega_i$. The current difference value δ(n) to be decoded is added by the adder 68 to the predicted value s'(n) to output the sum obtained in this way as a part of the decoded signal ŝ at the output 64. However, the sum is also input in the prediction means 66 which will use this value s(n) in the next predictions. Additionally, the prediction means 66 uses the difference value δ(n) from the coded signal stream to adapt the current prediction coefficients $\omega_i$, the adaption speed and the adaption precision being predetermined by the currently set speed parameter λ. The prediction coefficients $\omega_i$ are updated or adapted in this manner.

Figure 2:
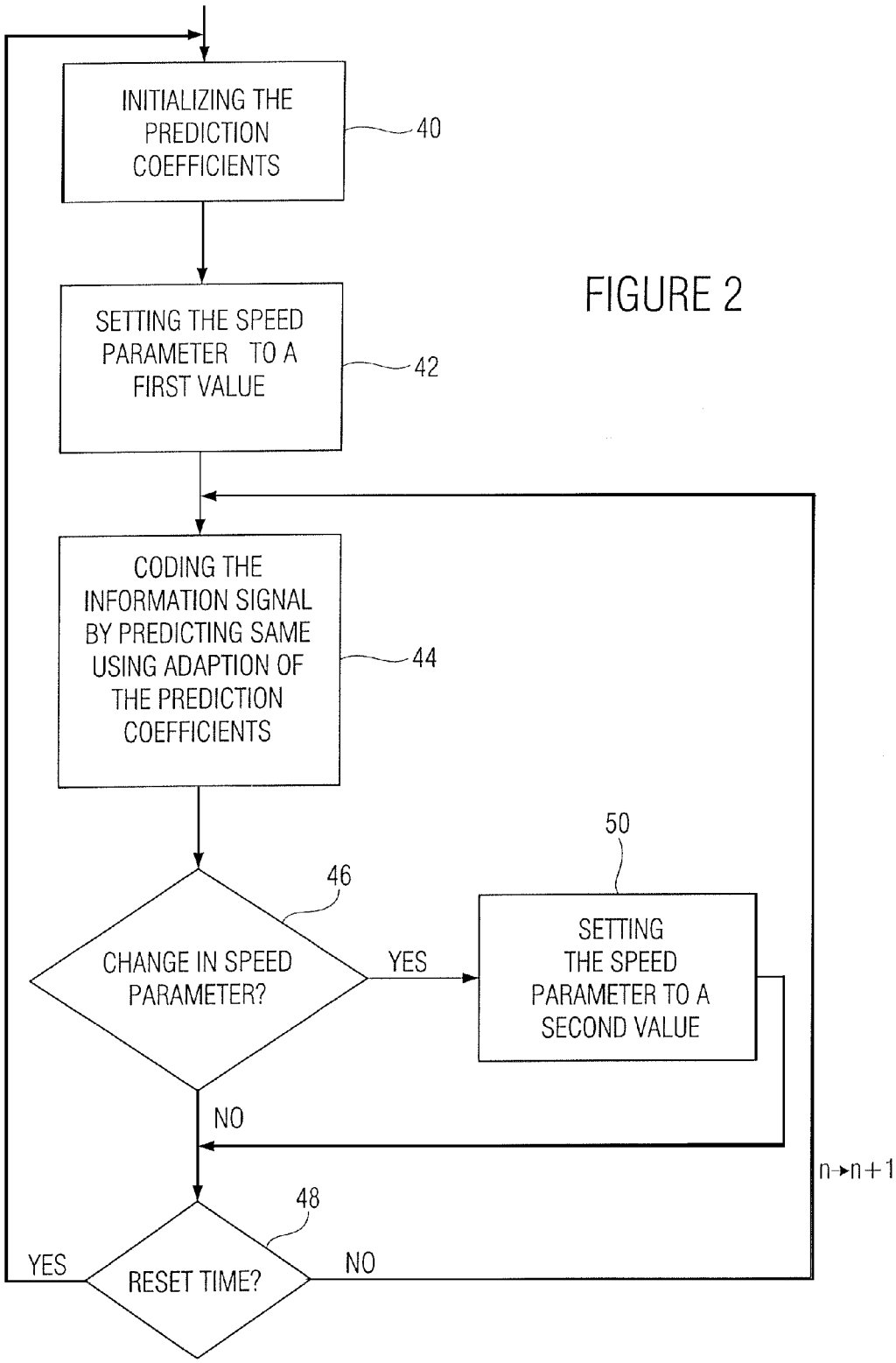
FIG. 2 shows a block circuit diagram for illustrating the mode of functioning of the coder of FIG. 1.

In step 96 corresponding to step 46 of FIG. 2, the control means checks whether a speed parameter change is to take place. If this is not the case, in step 98 corresponding to step 48 the control means 70 will determine whether there is a reset time. If this is not the case, the loop of steps 94-98 will be passed again, this time for the next signal value s(n) or the next difference value δ(n), as is indicated in FIG. 4 by "n→n+1".

If, however, there is a speed parameter alteration time in step 96, in step 100 the control means 70 will set the speed parameter λ to a second value corresponding to a lower adaption speed but higher adaption precision, as has already been discussed with regard to coding.

As has been mentioned, it is ensured either by information in the coded information signal 62 or by standardization that the speed parameter changes and reset times occur at the same positions or between the same signal values or decoded signal values, namely on the transmitter side and the receiver side.

After a predictive coding scheme according to an embodiment of the present invention has been described in general referring to FIGS. 1-4, a special embodiment of the prediction means 16 will be described now referring to FIGS. 5-7, wherein in this embodiment the prediction means 16 operates according to an LMS adaption algorithm.

Figure 5:
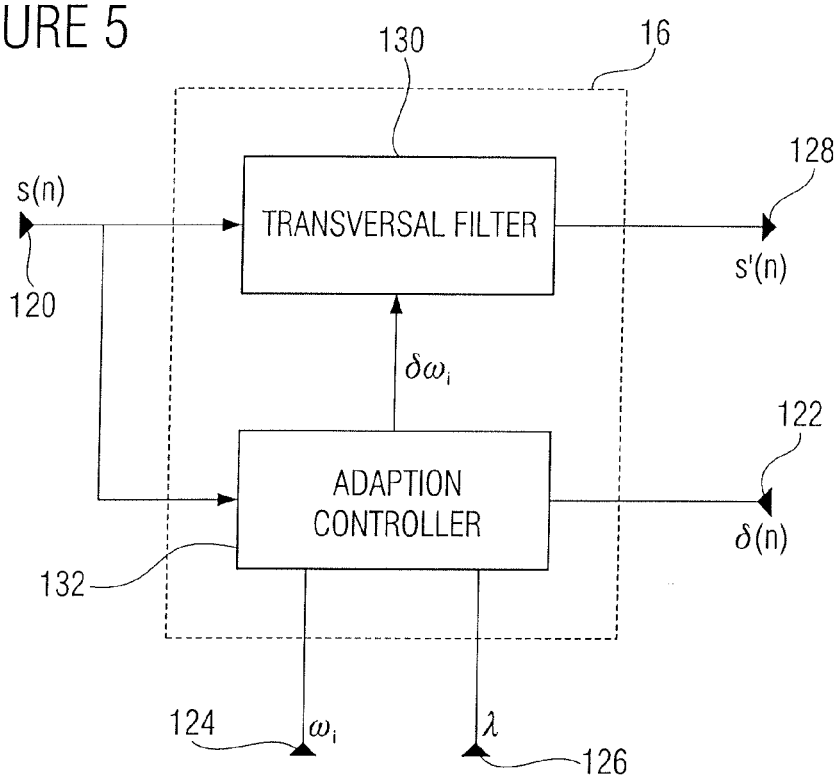
FIG. 5 shows a block circuit diagram of the prediction means of FIGS. 1 and 3 according to an embodiment of the present invention.

FIG. 5 shows the setup of the prediction means 16 according to the LMS algorithm embodiment. As has already been described referring to FIGS. 1 and 3, the prediction means 16 includes an input 120 for signal values s(n), and input 122 for prediction errors or difference values δ(n), two control inputs 124 and 126 for initializing the coefficients $\omega_i$ or setting the speed parameter δ and an output 128 for outputting the predicted value s'(n). Internally, the prediction means 16 includes a transversal filter 130 and an adaption controller 132. The transversal filter 130 is connected between the input 120 and the output 128. The adaption controller 132 is connected to the two control inputs 124 and 126 and additionally to the inputs 120 and 122 and also includes an output to pass on correction values $\delta\omega_i$ for the coefficients $\omega_i$ to the transversal filter 130.

The LMS algorithm implemented by the prediction means 16—maybe in cooperation with the subtracter 18 (FIG.

1)—is a linear adaptive filter algorithm which, put generally, consists of two basic processes:

1. A filter process including (a) calculating the output signal s'(n) of a linear filter responsive to an input signal s(n) by the transversal filter 130 and (b) generating an estimation error δ(n) by comparing the output signal s'(n) to a desired response s(n) by the subtracter 18 or obtaining the estimation error δ(n) from the coded information signal δ.
2. An adaptive process performed by the adaption controller 132 and comprising automatic adjustment of the filter coefficients $\omega_i$ of the transversal filter 130 according to the estimation error δ(n).

The combination of these two cooperating processes results in a feedback loop, as has already been discussed referring to FIGS. 1-4.

Figure 6:
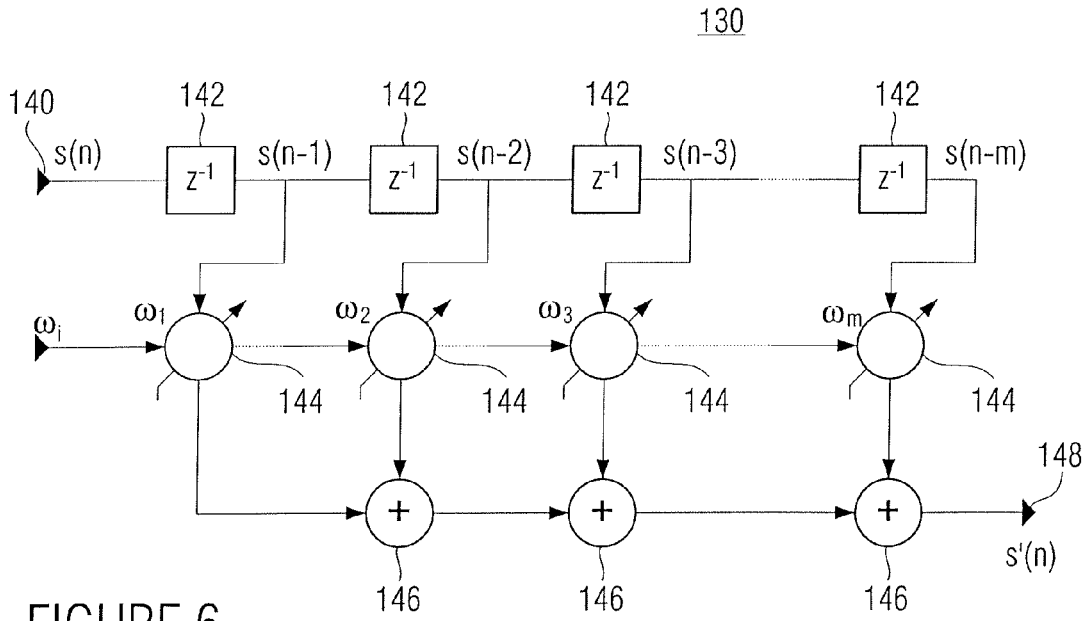
FIG. 6 shows a block circuit diagram of the transversal filter of FIG. 5 according to an embodiment of the present invention.

Details of the transversal filter 130 are illustrated in FIG. 6. The transversal filter 130 receives at an input 140 the sequence of signal values s(n). The input 140 is followed by a series connection of m delay elements 142 so that the signal values s(n−1) . . . s(n-m) preceding the current signal value s(n) are present at connective nodes between the m delay elements 142. Each of these signal values s(n−1) . . . s(n-m) or each of these connective nodes is applied to one of m weighting means 144 weighting or multiplying the respective applying signal value by a respective prediction weighting or a respective one of the filter coefficients $\omega_i$, i=1 . . . m. The weighting means 144 output their results to a respective one of a plurality of adders 146 connected in series so that the estimation value or predicted value s'(m) results to $\Sigma_{i=0}^{m}\omega_i \cdot s(n-i)$ at an output 148 of the transversal filter 130 from the sum of the last adder of the series connection.

In a broader sense, the estimation value s'(n) comes close to a value predicted according to the Wiener solution in a, in a broader sense, stationary surrounding when the number of iterations n reaches infinity.

Figure 7:
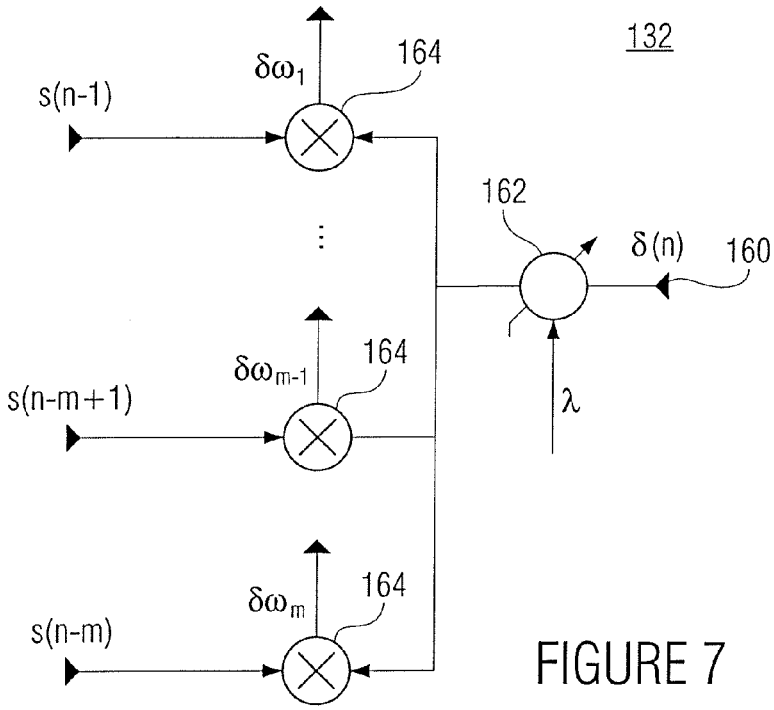
FIG. 7 shows a block circuit diagram of the adaption controller of FIG. 5 according to an embodiment of the present invention.

The adaption controller 132 is shown in greater detail in FIG. 7. The adaption controller 132 thus includes an input 160 where the sequence of difference values δ(n) is received. They are multiplied in weighting means 162 by the speed parameter λ, which is also referred to as step-size parameter. The result is fed to a plurality of m multiplication means 164 multiplying it by one of the signal values s(n−1) . . . s(n-m). The results of the multipliers 164 form correction values $\delta\omega_i$ . . . $\delta\omega_m$. Consequently, the correction values $\delta\omega_i$ . . . $\delta\omega_m$ represent a scalar version of the internal product of the estimation error δ(n) and the vector from signal values s(n−1) . . . s(n-m). These correction values are added before the next filter step to the current coefficients $\omega_i$ . . . $\omega_m$ so that the next iteration step, i.e. for the signal value s(n+1), in the transversal filter 130 is performed with the new adapted coefficients $\omega_i \rightarrow \omega_i + \delta\omega_i$.

The scaling factor λ used in the adaption controller 132 and, as has already been mentioned, referred to as step-size parameter may be considered to be a positive quantity and should meet certain conditions relative to the spectral content of the information signal in order for the LMS algorithm realized by the means 16 of FIGS. 5-7 to be stable. Here, stability is to mean that with increasing n, i.e. when the adaption is performed with infinite duration, the means square error generated by the filter 130 reaches a constant value. An algorithm meeting this condition is referred to as mean square stable.

An alteration of the speed parameter λ causes an alteration in the adaption precision, i.e. in precision, since the coefficients $\omega_i$ may be adjusted to an optimum set of coefficients. Maladjustment of the filter coefficients results in an increase in the mean square error or the energy in the difference values δ in the steady state $n \rightarrow \infty$. In particular, the feedback loop acting on the weights $\omega_i$ acts like a low-pass filter, the determination duration constant of which is inversely proportional to the parameter λ. Consequently, the adaptive process is slowed down by setting the parameter λ to a small value, wherein the effects of this gradient noise on the weights $\omega_i$ are largely filtered out. This has the reverse effect of reducing maladjustment.

Figure 8:
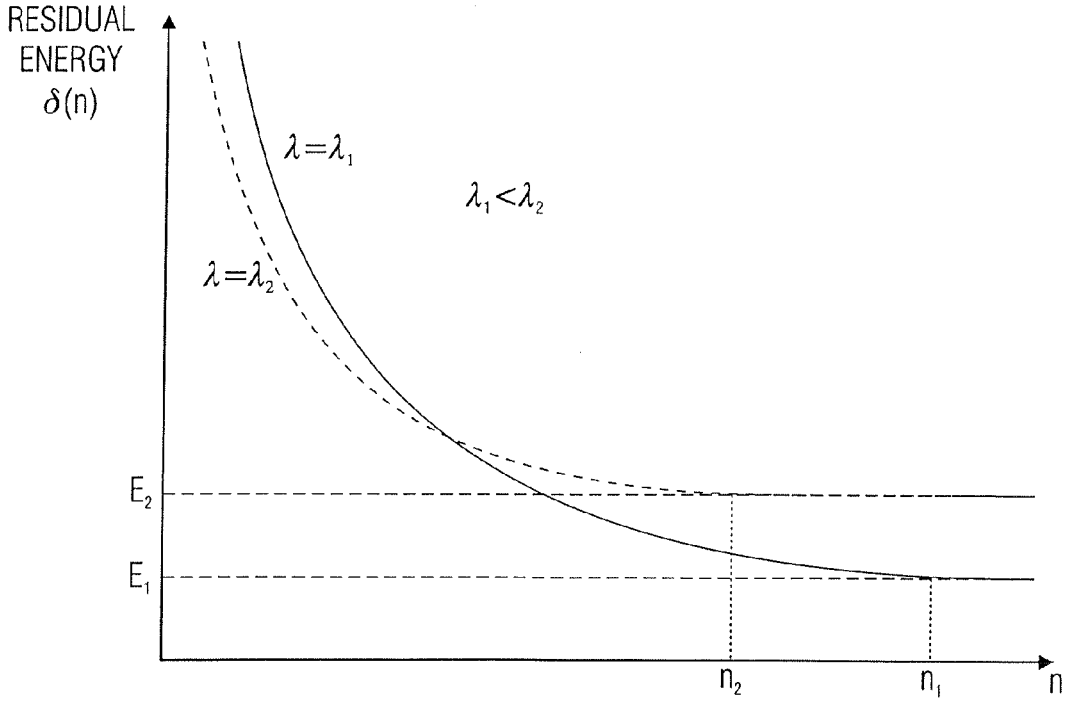
FIG. 8 shows a diagram for illustrating the behavior of the prediction means of FIG. 5 for two different fixedly set speed parameters.

FIG. 8 illustrates the influence of setting the parameter λ to different values $\lambda_1$ and $\lambda_2$ on the adaption behavior of the prediction means 16 of FIGS. 5-7 using a graph where the number of iterations n or the number of predictions and adaptions n is plotted along the x axis and the mean energy of the residual values δ(n) or the mean square error is plotted along the y axis. A continuous line refers to a speed parameter $\lambda_1$. As can be seen, the adaption to a stationary state where the mean energy of the residual values basically remains constant requires a number $n_1$ of iterations. The energy of the residual values in the settled or quasi-stationary state is $E_1$. A broken graph results for a greater speed parameter $\lambda_2$, wherein, as may be seen, fewer iterations, namely $n_2$, are required until the steady state is reached, wherein the steady state, however, entails a higher energy $E_2$ of the residual values. The settled state at $E_1$ or $E_2$ exhibits not only settling of the mean square error of the residual values or residuals to an asymptotic value, but also settling of the filter coefficients $\omega_i$ to the optimum set of filter coefficients with a certain precision which in the case of $\lambda_1$ is higher and in the case of $\lambda_2$ is lower.

If, however, as has been described referring to FIGS. 1-4, the speed parameter λ is at first set to the value $\lambda_2$, an adaption of the coefficients $\omega_i$ will at first be achieved quicker, wherein the change to $\lambda_1$ after a certain duration after the reset times then provides for the adaption precision for the following duration to be improved. All in all, a residual value energy graph allowing a higher compression than by one of the two parameter settings alone is achieved.

With regard to the above description of the figures, it is pointed out that the present invention is not limited to LMS algorithm implementations. Although, referring to FIGS. 5-8, the present invention has been described in greater detail with regard to the LMS algorithm as an adaptive prediction algorithm, the present invention may also be applied in connection with other adaptive prediction algorithms where matching between adaption speed on the one hand and adaption precision on the other hand may be performed via a speed parameter. Since the adaption precision in turn influences the energy of the residual value, the speed parameter may always at first be set such that the adaption speed is great, whereupon it is then set to a value where the adaption speed is small, but the adaption precision is greater and thus the energy of the residual values is smaller. With such prediction algorithms, for example, there need not be a connection between the input 120 and the adaption controller 132.

Additionally, it is pointed out that, instead of the fixed duration described above after the reset times for triggering the speed parameter change, triggering may also be performed depending on the adaption degree, such as, for example, triggering a speed parameter change when the coefficient corrections δω, such as, for example, a sum of the absolute values thereof, fall below a certain value, indicating an approximation to the quasi-stationary state, as is shown in FIG. 8, to a certain approximation degree.

In particular, it is pointed out that depending on the circumstances the inventive scheme may also be implemented in software. The implementation may be on a digital storage medium, in particular on a disc or a CD having control signals which may be read out electronically which can cooperate with a programmable computer system such that the corresponding method will be executed. In general, the invention thus also is in a computer program product having a program code stored on a machine-readable carrier for performing the inventive method when the computer program product runs on a computer. Put differently, the invention may thus also be realized as a computer program having a program code for performing the method when the computer program runs on a computer.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. A method for predictively coding an information signal including a sequence of information values by means of an adaptive prediction algorithm the prediction coefficients of which may be initialized and which is controllable by a speed parameter to operate with a first adaption speed and a first adaption precision in the case that the speed parameter has a first value and to operate with a second, compared to the first one, lower adaption speed and a second, compared to the first one, higher adaption precision in the case that the speed parameter has a second value, comprising the steps of:

A) initializing the prediction coefficients;

B) controlling the adaptive prediction algorithm to set the speed parameter to the first value;

C) coding successive information values of the information signal by means of the adaptive prediction algorithm with the speed parameter set to the first value as long as a predetermined duration after step B) has not expired to code a first part of the information signal;

D) after expiry of the predetermined duration after step B), controlling the adaptive prediction algorithm to set the speed parameter to the second value; and E) coding information values of the information signal following the information values coded in step C) by means of the adaptive prediction algorithm with the speed parameter set to the second value to code a second part of the information signal following the first part, the information signal being one of an audio signal and a video signal.

2. The method according to claim 1, wherein step C) is performed using adaption of the prediction coefficients initialized in step A) to obtain adapted prediction coefficients and wherein step E) is performed using adaption of the adapted prediction coefficients.

3. The method according to claim 1, wherein steps A)-E) are repeated intermittently at predetermined times to code successive sections of the information signal.

4. The method according to claim 3, wherein the predetermined times cyclically return in a predetermined time interval.

5. The method according to claim 1, wherein step D) is performed after a predetermined duration has passed after step B).

6. The method according to claim 1, wherein from steps C) and E) differences between information values of the information signal and predicted values are obtained representing a coded version of the information signal.

7. A device for predictively coding an information signal including a sequence of information values, comprising:

a processor for performing an adaptive prediction algorithm the prediction coefficients of which may be initialized and which is controllable by a speed parameter to operate with a first adaption speed and a first adaption precision in the case that the speed parameter has a first value and to operate with a second, compared to the first one, lower adaption speed and a second, compared to the first one, higher adaption precision in the case that the speed parameter has a second value; and a controller coupled to the processor for performing the adaptive prediction algorithm and effective to cause:

A) initialization of the prediction coefficients;

B) control of the adaptive prediction algorithm to set the speed parameter to the first value;

C) coding of successive information values of the information signal by means of the adaptive prediction algorithm with the speed parameter set to the first value as long as a predetermined duration after the control B) has not expired to code a first part of the information signal;

D) after expiry of the predetermined duration after the control B), control of the adaptive prediction algorithm to set the speed parameter to the second value; and E) coding of information values of the information signal following the information values coded in the coding C) by means of the adaptive prediction algorithm with the speed parameter set to the second value to code a second part of the information signal following the first part, the information signal being one of an audio signal and a video signal.

8. The device according to claim 7, wherein the controller is formed to cause coding C) to be performed using adaption of the prediction coefficients initialized in A) to obtain adapted prediction coefficients and coding E) to be performed using adaption of the adapted prediction coefficients.

9. The device according to claim 6, wherein the controller causes steps A)-E) to be repeated intermittently at predetermined times to code successive sections of the information signal.

10. The device according to claim 9, wherein the controller is formed such that the predetermined times cyclically return in a predetermined time interval.

11. The device according to claim 9, wherein the controller causes step D) to be performed after a certain duration after step B) has been performed.

12. The device according to claim 7, wherein the processor for performing an adaptive prediction algorithm is formed to obtain differences between information values of the information signal and predicted values representing a coded version of the information signal.

13. A method for decoding a predictively coded information signal including a sequence of difference values by means of an adaptive prediction algorithm the prediction coefficients of which may be initialized and which is controllable by a speed parameter to operate with a first adaption speed and a first adaption precision in the case that the speed parameter has a first value and to operate with a second, compared to the first one, lower adaption speed and a second, compared to the first one, higher adaption precision in the case that the speed parameter has a second value, comprising the steps of:

F) initializing the prediction coefficients;

G) controlling the adaptive prediction algorithm to set the speed parameter to the first value;

H) decoding successive difference values of the predictively coded information signal by means of the adaptive prediction algorithm with the speed parameter set to the first value as long as a predetermined duration after step G) has not expired to decode a first part of the predictively coded information signal;

I) after expiry of the predetermined duration after step G), controlling the adaptive prediction algorithm to set the speed parameter to the second value; and J) decoding difference values of the predictively coded information signal following the difference values decoded in step H) by means of the adaptive prediction algorithm with the speed parameter set to the second value to decode a second part of the predictively coded information signal, the information signal being one of an audio signal and a video signal.

14. The method according to claim 13, wherein step H) is performed using adaption of the prediction coefficients initialized in step F) to obtain adapted prediction coefficients, and wherein step J) is performed using adaption of the adapted prediction coefficients.

15. The method according to claim 13, wherein steps F)-J) are repeated intermittently at predetermined times to decode successive sections of the predictively coded information signal.

16. The method according to claim 15, wherein the predetermined times cyclically return in a predetermined time interval.

17. The method according to claim 13, wherein step I) is performed after a predetermined duration has passed after step G).

18. The method according to claim 13, wherein steps H) and J) include adding differences in the predictively coded information signal and predicted values.

19. A device for decoding a predictively coded information signal including a sequence of difference values, comprising:

a processor for performing an adaptive prediction algorithm the prediction coefficients of which may be initialized and which is controllable by a speed parameter to operate with a first adaption speed and a first adaption precision in the case that the speed parameter has a first value and to operate with a second, compared to the first one, lower adaption speed and a second, compared to the first one, higher adaption precision in the case that the speed parameter has a second value; and a controller coupled to the processor for performing the adaptive prediction algorithm and effective to cause:

F) initialization of the prediction coefficients;

G) control of the adaptive prediction algorithm to set the speed parameter to the first value;

H) decoding of successive difference values of the predictively coded information signal by means of the adaptive prediction algorithm with the speed parameter set to the first value as long as a predetermined duration after the control G) has not expired to decode a first part of the predictively coded information signal;

I) after expiry of the predetermined duration after the control G), control of the adaptive prediction algorithm to set the speed parameter to the second value; and J) decoding of difference values of the predictively coded information signal following the difference values decoded in the decoding H) by means of the adaptive prediction algorithm with the speed parameter set to the second value to decode a second part of the predictively coded information signal, the information signal being one of an audio signal and a video signal.

20. The device according to claim 19, wherein the controller is formed to cause the coding H) to be performed using adaption of the prediction coefficients initialized in F) to obtain adapted prediction coefficients, and the coding J) to be performed using adaption of the adapted prediction coefficients.

21. The device according to claim 19, wherein the controller is formed to cause steps F)-J) to be repeated intermittently at predetermined times to decode successive sections of the predictively coded information signal.

22. The device according to claim 21, wherein the controller is formed such that the predetermined times cyclically return in a predetermined time interval.

23. The device according to claim 19, wherein the controller is formed such that step I) is performed after a predetermined duration after step G) has passed.

24. The device according to claim 19, wherein the processor for performing an adaptive prediction algorithm includes an adder for adding differences in the predictively coded information signal and predicted values.

25. A computer program having a program code for performing a method for predictively coding an information signal including a sequence of information values by means of an adaptive prediction algorithm the prediction coefficients of which may be initialized and which is controllable by a speed parameter to operate with a first adaption speed and a first adaption precision in the case that the speed parameter has a first value and to operate with a second, compared to the first one, lower adaption speed and a second, compared to the first one, higher adaption precision in the case that the speed parameter has a second value, comprising the steps of: A) initializing the prediction coefficients; B) controlling the adaptive prediction algorithm to set the speed parameter to the first value; C) coding successive information values of the information signal by means of the adaptive prediction algorithm with the speed parameter set to the first value as long as a predetermined duration after step B) has not expired to code a first part of the information signal; D) after expiry of the predetermined duration after step B), controlling the adaptive prediction algorithm to set the speed parameter to the second value; and E) coding information values of the information signal following the information values coded in step C) by means of the adaptive prediction algorithm with the speed parameter set to the second value to code a second part of the information signal following the first part when the computer program runs on a computer, the information signal being one of an audio signal and a video signal.

26. A computer program having a program code for performing a method for decoding a predictively coded information signal including a sequence of difference values by means of an adaptive prediction algorithm the prediction coefficients of which may be initialized and which is controllable by a speed parameter to operate with a first adaption speed and a first adaption precision in the case that the speed parameter has a first value and to operate with a second, compared to the first one, lower adaption speed and a second, compared to the first one, higher adaption precision in the case that the speed parameter has a second value, comprising the steps of: F) initializing the prediction coefficients; G) controlling the adaptive prediction algorithm to set the speed parameter to the first value; H) decoding successive difference values of the predictively coded information signal by means of the adaptive prediction algorithm with the speed parameter set to the first value as long as a predetermined duration after step G) has not expired to decode a first part of the predictively coded information signal; I) after expiry of the predetermined duration after step G), controlling the adaptive prediction algorithm to set the speed parameter to the second value; and J) decoding difference values of the predictively coded information signal following the difference values decoded in step H) by means of the adaptive prediction algorithm with the speed parameter set to the second value to decode a second part of the predictively coded information signal when the computer program runs on a computer, the information signal being one of an audio signal and a video signal.

* * * * *